US012460846B2

(12) United States Patent
Molavi-Tabrizi

(10) Patent No.: US 12,460,846 B2
(45) Date of Patent: Nov. 4, 2025

(54) MULTI-LEVEL OIL VAPORIZER FOR REFRIGERATION SYSTEM

(71) Applicant: Carrier Corporation, Palm Beach Gardens, FL (US)

(72) Inventor: Anthony S. Molavi-Tabrizi, Mooresville, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 234 days.

(21) Appl. No.: 18/156,561

(22) Filed: Jan. 19, 2023

(65) Prior Publication Data

US 2023/0228471 A1 Jul. 20, 2023

Related U.S. Application Data

(60) Provisional application No. 63/300,702, filed on Jan. 19, 2022.

(51) Int. Cl.
*F25B 43/02* (2006.01)

(52) U.S. Cl.
CPC ..... *F25B 43/02* (2013.01); *F25B 2400/01* (2013.01)

(58) Field of Classification Search
CPC .. F25B 1/047; F25B 43/02; F25B 1/00; F25B 31/004; F25B 2400/01; F25B 2400/05; F25B 2400/051; F25B 2400/053; F25B 2400/16; F25B 2400/23
See application file for complete search history.

(56) References Cited

U.S. PATENT DOCUMENTS

| | | | | |
|---|---|---|---|---|
| 4,645,904 | A | 2/1987 | Moraski et al. | |
| 6,082,982 | A | 7/2000 | Rosser, Jr. et al. | |
| 6,672,102 | B1 * | 1/2004 | Huenniger | F25B 31/004 62/472 |
| 6,739,147 | B1 | 5/2004 | Sishtla | |
| 9,746,220 | B2 | 8/2017 | Molavi | |
| 11,029,065 | B2 | 6/2021 | Molavi | |
| 2008/0271477 | A1 | 11/2008 | Holmes | |

(Continued)

FOREIGN PATENT DOCUMENTS

| | | | |
|---|---|---|---|
| CN | 202313741 | U | 12/2012 |
| CN | 202613741 | U | 12/2012 |

(Continued)

OTHER PUBLICATIONS

European Search Report for application EP 23152167.5, dated Jun. 7, 2023, 44 pages.

*Primary Examiner* — Len Tran
*Assistant Examiner* — Kamran Tavakoldavani
(74) *Attorney, Agent, or Firm* — CANTOR COLBURN LLP

(57) ABSTRACT

A vaporizer includes an inner shell through which a refrigerant and oil mixture is flowed, and one or more hot gas pathways extending through the inner shell from a hot gas inlet to a hot gas outlet, through which a hot gas is flowed to boil refrigerant in the refrigerant and oil mixture. The inner shell is embedded in an outer shell. The outer shell defines a sump fluidly connected to the inner shell via a sump inlet line to deliver the refrigerant and oil mixture from the inner shell to the sump. A sump heater is located in the sump, which is configured to boil additional refrigerant from the refrigerant and oil mixture.

18 Claims, 6 Drawing Sheets

(56) References Cited

U.S. PATENT DOCUMENTS

| | | | | |
|---|---|---|---|---|
| 2016/0265824 | A1* | 9/2016 | Molavi | F25B 31/004 |
| 2020/0027580 | A1 | 1/2020 | Deck et al. | |
| 2020/0271402 | A1 | 8/2020 | Wu et al. | |
| 2020/0292220 | A1* | 9/2020 | Kato | F25B 31/004 |

FOREIGN PATENT DOCUMENTS

| | | | |
|---|---|---|---|
| CN | 203177433 | U | 9/2013 |
| CN | 203421831 | U | 2/2014 |
| CN | 105222110 | A | 1/2016 |
| CN | 105547015 | A | 5/2016 |
| EP | 3034965 | B1 | 6/2021 |
| JP | 2000295956 | A | 10/2000 |
| WO | 2009048458 | A1 | 4/2009 |
| WO | 2013032611 | A2 | 3/2013 |
| WO | 2015069373 | A1 | 5/2015 |
| WO | 2016192684 | A1 | 12/2016 |
| WO | 2017066575 | A1 | 4/2017 |

* cited by examiner

MULTI-LEVEL OIL VAPORIZER FOR REFRIGERATION SYSTEM

CROSS-REFERENCE TO RELATED APPLICATIONS

This application claims the benefit of U.S. Provisional Application No. 63/300,702 filed Jan. 19, 2022, the disclosure of which is incorporated herein by reference in its entirety.

BACKGROUND

Exemplary embodiments pertain to the art of refrigerant systems, and more particularly to oil recovery from a refrigerant stream of a refrigerant system.

In a typical refrigerant system, such as a chiller system, a compressor of the refrigerant system is utilized to compress a flow of refrigerant and deliver the compressed refrigerant to a condenser. The compressor is typically provided with lubricant, such as oil, which is utilized to lubricate various components (e.g., bearings and other running surfaces of the compressor). The oil is often mixed with the refrigerant within the compressor. The oil is typically separated from the refrigerant and recirculated to the compressor. In some systems, one or more vaporizer is utilized to separate the refrigerant from the oil (e.g., by boiling off the refrigerant from the combined refrigerant and oil stream). Existing vaporizer technology, however, may have shortcomings in operation during low-lift operation of the refrigerant system, and/or at low compressor operating loads or RPMs or high evaporating temperatures.

BRIEF DESCRIPTION

In one embodiment, a vaporizer includes an inner shell through which a refrigerant and oil mixture is flowed, and one or more hot gas pathways extending through the inner shell from a hot gas inlet to a hot gas outlet, through which a hot gas is flowed to boil refrigerant in the refrigerant and oil mixture. The inner shell is embedded in an outer shell. The outer shell defines a sump fluidly connected to the inner shell via a sump inlet line to deliver the refrigerant and oil mixture from the inner shell to the sump. A sump heater is located in the sump, which configured to boil additional refrigerant from the refrigerant and oil mixture.

Additionally or alternatively, in this or other embodiments a vaporizer immersed heater is located in the inner shell. The vaporizer immersed heater is configured to aid in boiling of refrigerant in the refrigerant and oil mixture.

Additionally or alternatively, in this or other embodiments a vaporizer vent port removes boiled vapor refrigerant from the inner shell.

Additionally or alternatively, in this or other embodiments an oil return line is operably connected to the sump to remove oil from the sump.

Additionally or alternatively, in this or other embodiments an oil pump is operably connected to the oil return line.

Additionally or alternatively, in this or other embodiments an oil recirculation line is operably connected to the oil return line to return oil to the sump.

Additionally or alternatively, in this or other embodiments the hot gas outlet is positioned at a first end of the inner shell and the hot gas outlet is positioned at a second end of the inner shell opposite the first end.

Additionally or alternatively, in this or other embodiments the inner shell and the sump are located in a common outer shell.

In another embodiment, a chiller system includes a main refrigerant circuit through which a flow of refrigerant is circulated. The main refrigerant circuit includes a compressor, a condenser, and an evaporator. A vaporizer is fluidly connected to the main refrigerant circuit to remove refrigerant from a refrigerant and oil mixture. The vaporizer includes an inner shell through which the refrigerant and oil mixture is flowed, and one or more hot gas pathways extending through the inner shell from a hot gas inlet to a hot gas outlet, through which a hot gas is flowed to boil refrigerant in the refrigerant and oil mixture. The inner shell is embedded in an outer shell. The outer shell defines a sump fluidly connected to the inner shell via a sump inlet line to deliver the refrigerant and oil mixture from the inner shell to the sump. A sump heater is located in the sump to boil additional refrigerant from the refrigerant and oil mixture.

Additionally or alternatively, in this or other embodiments a hot gas line delivers the hot gas from the condenser to the hot gas inlet of the vaporizer.

Additionally or alternatively, in this or other embodiments a gas return line delivers the hot gas from the hot gas outlet to the evaporator.

Additionally or alternatively, in this or other embodiments a vaporizer immersed heater is located in the inner shell. The vaporizer immersed multi-stage heater is configured to aid in boiling of refrigerant in the refrigerant and oil mixture.

Additionally or alternatively, in this or other embodiments a vaporizer vent port removes boiled vapor refrigerant from the inner shell.

Additionally or alternatively, in this or other embodiments a compressor return line delivers the boiled vapor refrigerant from the vaporizer vent port to the compressor.

Additionally or alternatively, in this or other embodiments an oil return line is operably connected to the sump to remove oil from the sump.

Additionally or alternatively, in this or other embodiments the oil return line is configured to deliver oil from the sump to the compressor.

Additionally or alternatively, in this or other embodiments an oil pump is operably connected to the oil return line.

Additionally or alternatively, in this or other embodiments an oil recirculation line is operably connected to the oil return line to return oil to the sump.

Additionally or alternatively, in this or other embodiments the hot gas outlet is located at a first end of the inner shell and the hot gas outlet is located at a second end of the inner shell opposite the first end.

Additionally or alternatively, in this or other embodiments the inner shell and the sump are located in common outer shell.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
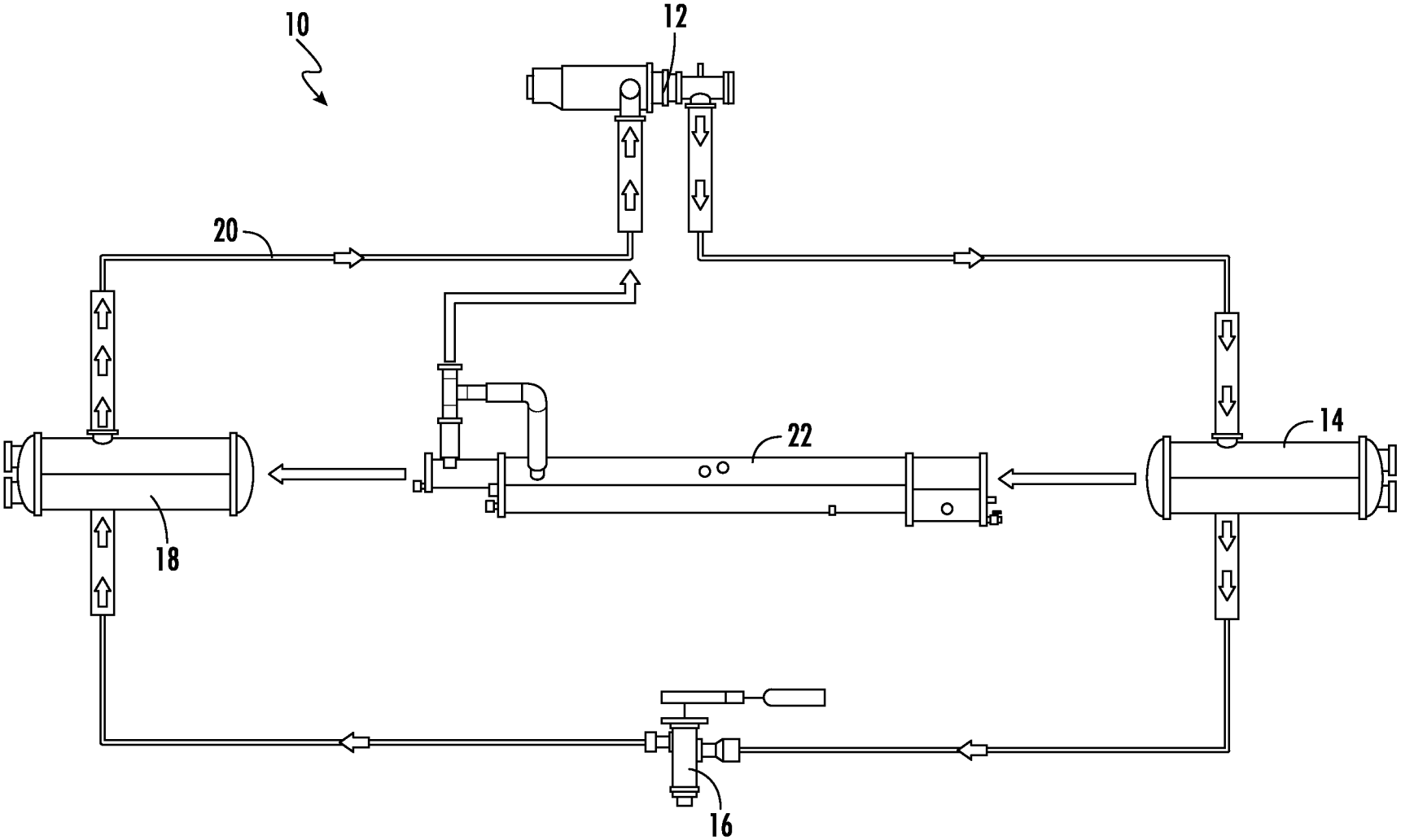
FIG. 1 is a schematic illustration of an embodiment of an exemplary chiller system.

Referring now to FIG. 1, shown is a schematic illustration of an exemplary chiller system 10. The chiller system 10 includes a compressor 12, for example a screw compressor or other configuration, a condenser 14, an expansion device 16 and an evaporator 18 arranged serially along a main refrigerant pathway 20 through which a flow of refrigerant is circulated. As the chiller system 10 operates, oil (e.g., which may be used to lubricate bearings and other running surfaces of the compressor) mixes with the flow of refrigerant. A vaporizer 22 is interconnected to the main refrigerant pathway 20 to remove oil from the flow of refrigerant and return the oil to the compressor 12, as will be described in more detail below.

Figure 2:
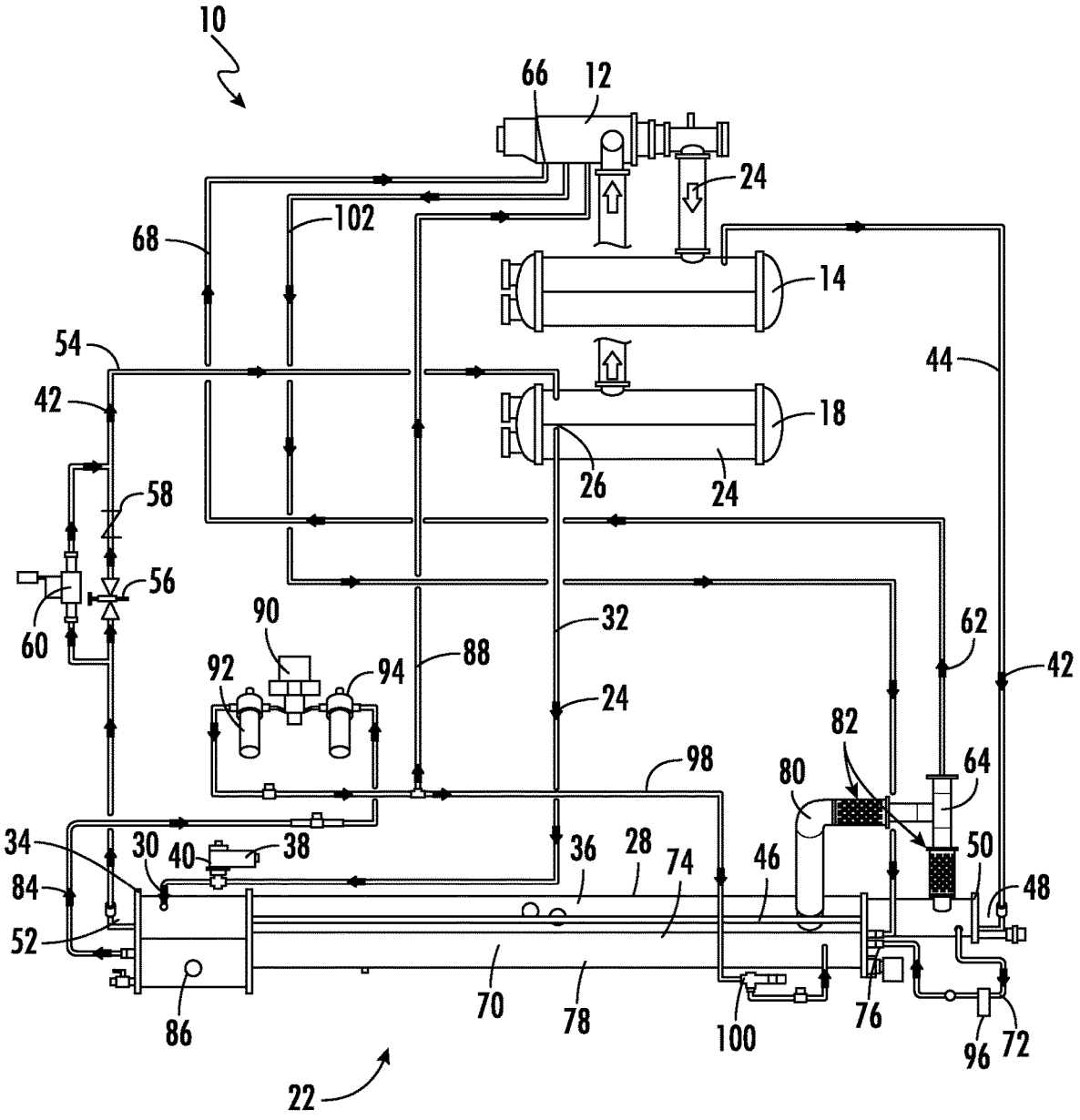
FIG. 2 is a schematic illustration of an exemplary chiller system including operation of a vaporizer.

Referring now to FIG. 2, the configuration and operation of the vaporizer 22 will be described in more detail. The compressor 12 delivers a refrigerant and oil mixture 24 to the condenser 14, which is carried to the evaporator 18 by the main refrigerant pathway 20 (shown in FIG. 1). One or more skim ports 26 at the evaporator 18 are utilized to extract at least a portion of the refrigerant and oil mixture 24 from the evaporator 18, and the refrigerant and oil mixture 24 is delivered to the vaporizer 22 at a refrigerant inlet 30 by a refrigerant inlet line 32.

Figure 3:
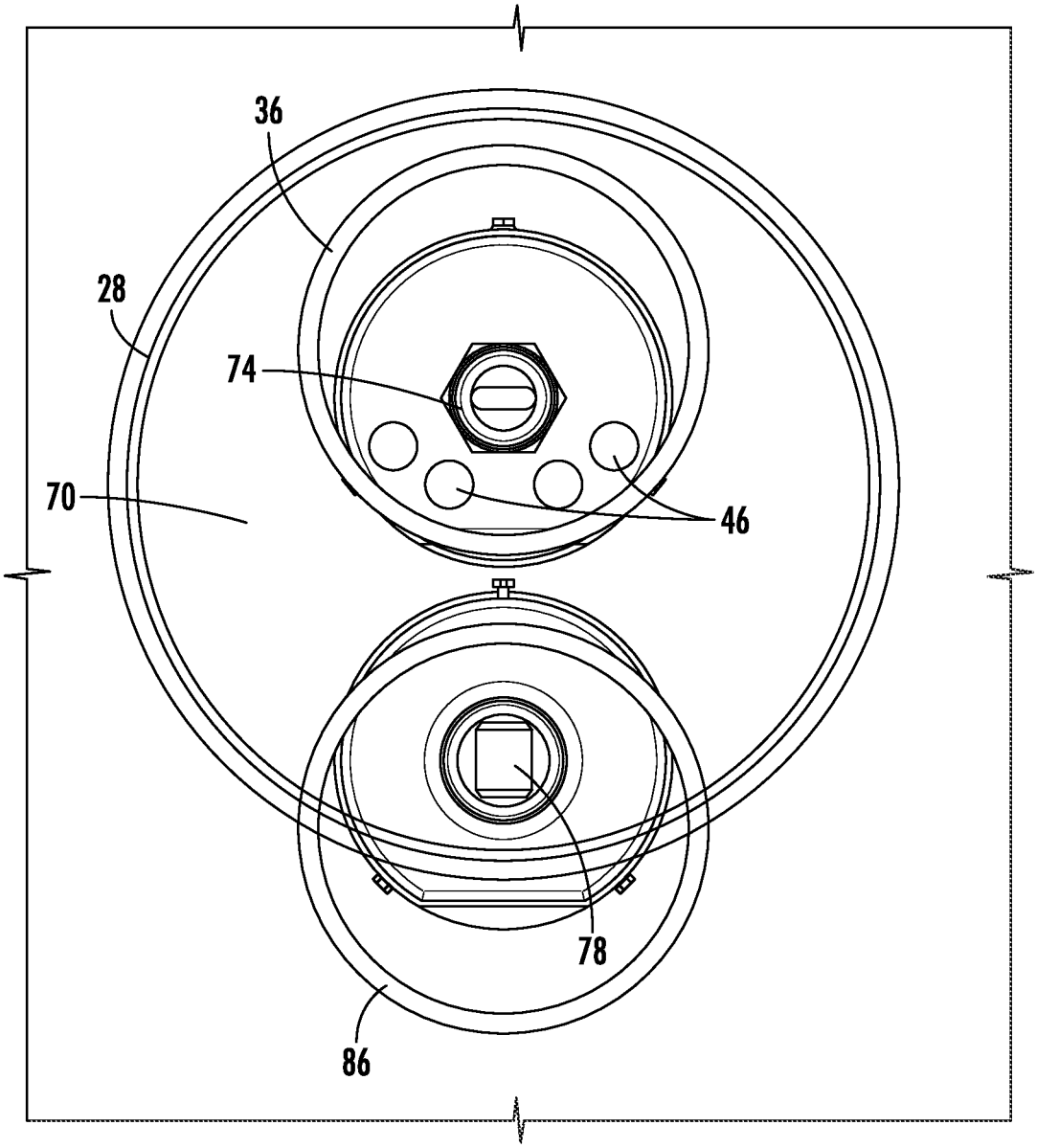
FIG. 3 is a cross-sectional illustration of an embodiment of an exemplary vaporizer.

Referring now to FIG. 3, the vaporizer 22 includes an outer shell 28 and an inner shell 36 embedded in the outer shell 28. Referring again to FIG. 2, the refrigerant and oil mixture 24 is directed into the inner shell 36 from the refrigerant inlet 30. In some embodiments the refrigerant inlet 30 is located at a first axial end 34 of the inner shell 36. In some embodiments, an oil reclaim actuator 38 is located along the refrigerant inlet line 32, which includes a modulating valve 40 to control a mass flow of the refrigerant and oil mixture 24 into the refrigerant inlet 30. A hot gas flow 42 from the condenser 14 is delivered to the vaporizer 22 along a hot gas line 44 and flows through one or more hot gas pathways 46 inside the inner shell 36, shown in FIG. 3. The one or more hot gas pathways 46 are connected to the hot gas line 44 at a hot gas inlet 48 of the inner shell 36. In some embodiments, the hot gas inlet 48 is located at a second axial end 50 of the inner shell 36, opposite the first axial end 34.

The refrigerant and oil mixture 24 exchange thermal energy with the hot gas flow 42 in the inner shell 36, boiling the refrigerant in the refrigerant and oil mixture 24. In some embodiments, a vaporizer immersed heater 74 is located in the inner shell 36. The vaporizer immersed heater 74 may be selectably activated depending on operating conditions of the chiller system 10 to aid in boiling the refrigerant in the refrigerant and oil mixture 24. The hot gas flow 42 exits the inner shell 36, at a hot gas outlet 52, which in some embodiments is located at the first axial end 34. A gas return line 54 is connected to the hot gas outlet 52 and the evaporator 18 to deliver the hot gas flow 42 from the hot gas outlet 52 to the evaporator 18. In some embodiments, a metered orifice 56, such as a needle valve, is located along the gas return line 54 to modulate the hot gas flow 42 along the gas return line 54. The metered orifice 56 arrangement may further include a check valve 58 and/or a solenoid valve 60, which is fully opened during low load and/or low RPM operation of the chiller system 10.

The boiled vapor refrigerant 62 exits the vaporizer 22 at a vaporizer vent port 64 and is returned to a compressor inlet 66 via a compressor return line 68. In some embodiments the vaporizer vent port 64 is located at the second axial end 50 of the vaporizer inner shell 36. The refrigerant and oil mixture 24 remaining in the inner shell 36 is delivered to a sump 70, defined by the outer shell 28, via a sump inlet line 72 through a sump inlet port 76. In some embodiments a sump thermistor 96 is positioned along the sump inlet line 72.

The sump 70 has a sump heater 78 positioned therein to boil additional refrigerant from the refrigerant and oil mixture 24 in the sump 70. The boiled refrigerant exits the sump 70 via a sump vapor refrigerant outlet 80 and proceeds to the compressor return line 68 via the vaporizer vent port 64. In some embodiments, the sump refrigerant outlet 80 and the vaporizer vent port 64 include mist eliminators 82. The mist eliminators 80 may be used to prevent, or at least mitigate, any possible liquid refrigerant droplet migration back to compressor 12. The oil 84 extracted from the sump 70 proceeds to a sump reservoir 86, where it is urged to the compressor 12 through an oil return line 88 as needed by an oil pump 90. In some embodiments, an in-line pre oil pump filter 92 and/or a post oil pump filter 94 are disposed along the oil return line 88. When not needed by the compressor 12, the oil pump 90 recirculates the oil 84 through the sump 70 via a recirculation line 98. In some embodiments, an oil pressure regulating valve 100 is positioned along the recirculation line 98 to control the flow of the oil 84 to the compressor 12, and returns excess oil 84 to the sump 70 via the recirculation line 98. In some embodiments, an oil drain line 102 connects the compressor 12 to the sump 70, through which oil is drained from the compressor 12 to the sump 70.

This unitary construction of the vaporizer 22, with the inner shell 36 embedded in the outer shell 28, as shown in FIG. 3, allows for easier installation and servicing of the vaporizer 22. The vaporizer disclosed herein allows for maintaining optimum viscosity of oil at low loads, low lifts, low RPMs and high evaporating temperatures where previous vaporizers failed to operate.

Figure 4:
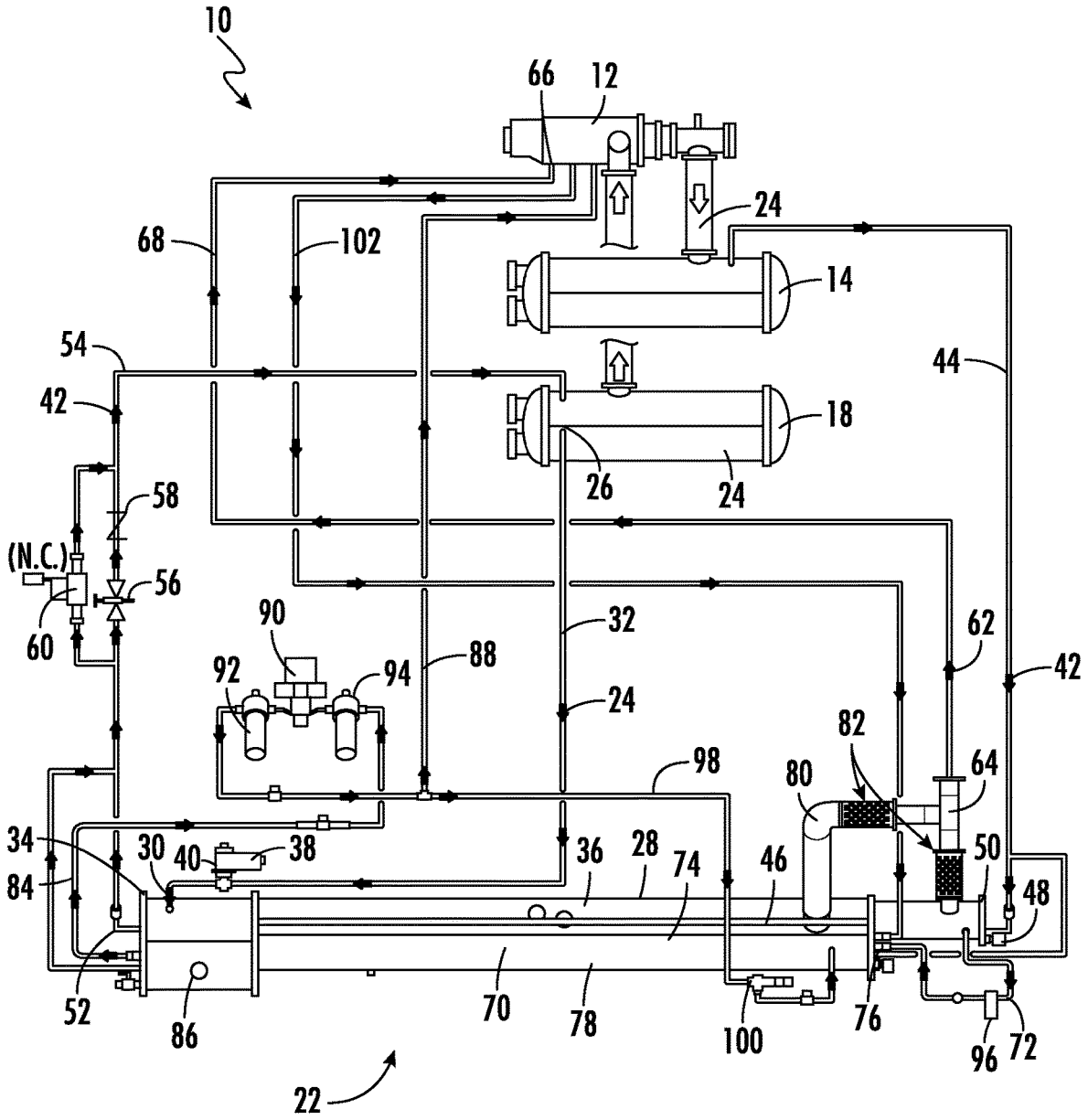
FIG. 4 is a schematic illustration of another embodiment of an exemplary chiller system including operation of a vaporizer.
Figure 5:
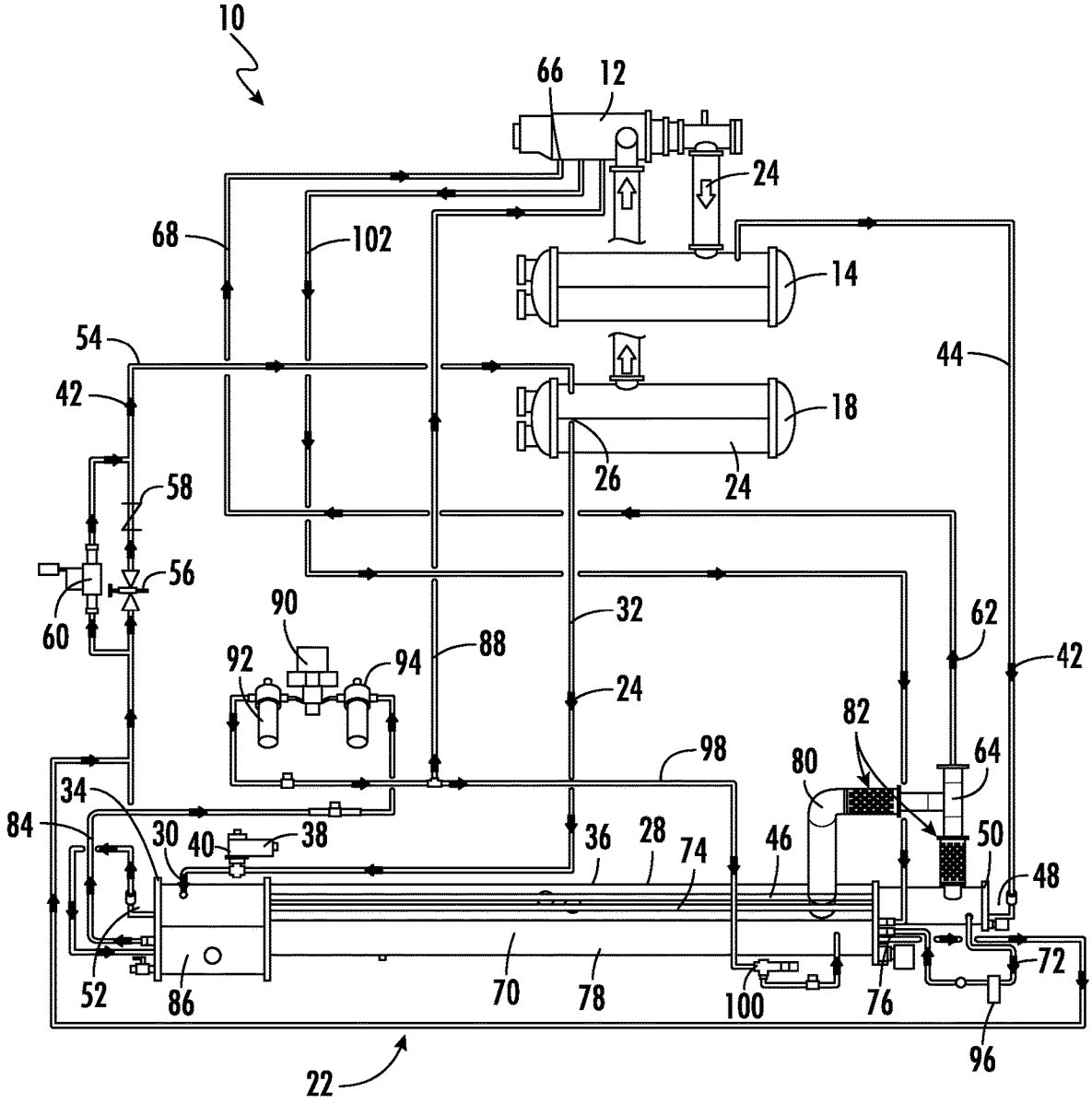
FIG. 5 is a schematic illustration of another embodiment of an exemplary chiller system including operation of a vaporizer.
Figure 6:
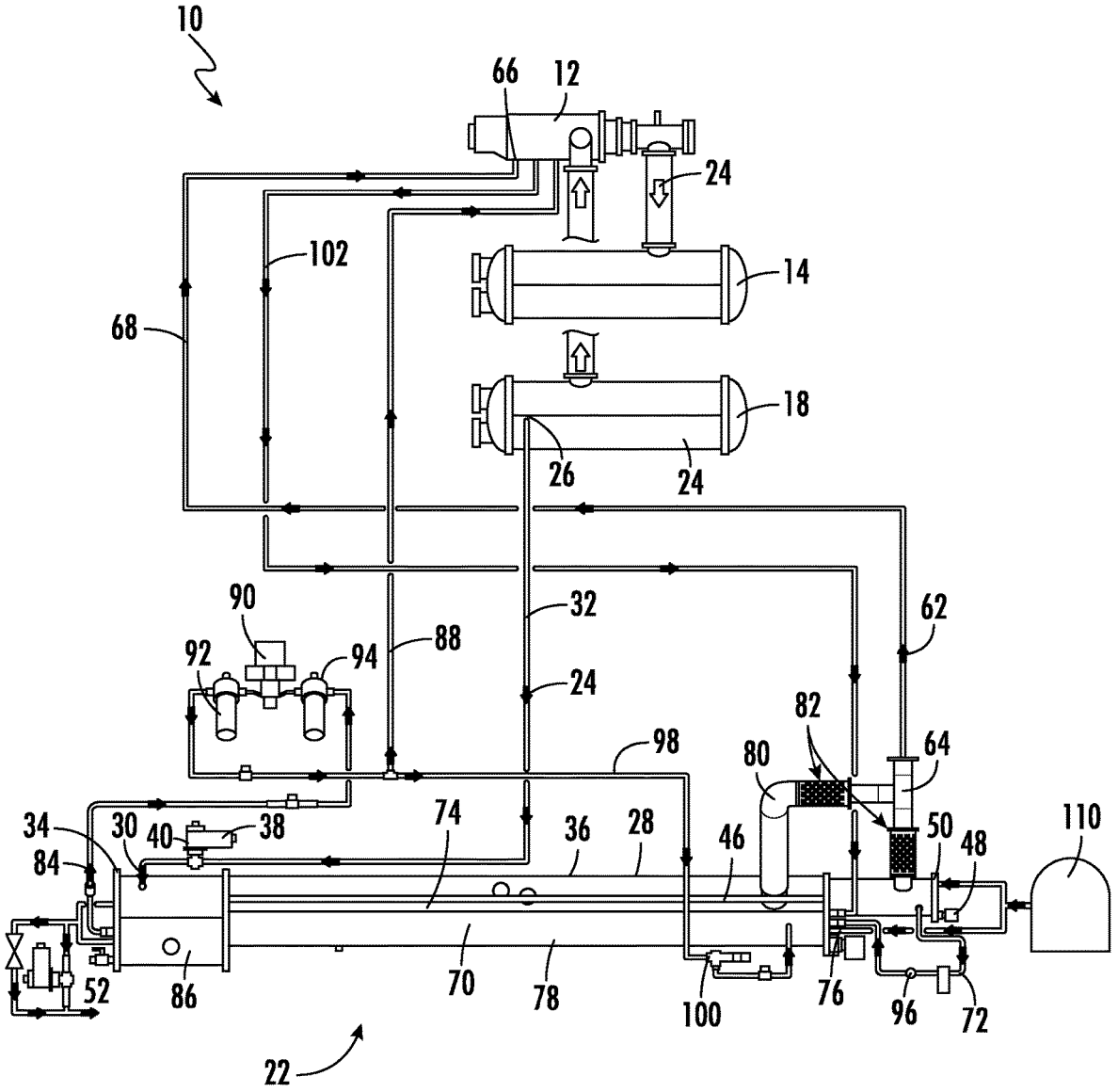
FIG. 6 is a schematic illustration of another embodiment of an exemplary chiller system including operation of a vaporizer.

While one embodiment of chiller system 10 and vaporizer 22 is illustrated in FIG. 2, other embodiments are illustrated in FIGS. 4-6. In the embodiment of FIG. 4, the hot gas line 44 extends to both the inner shell 36 and the sump 70, so that the hot gas flow 42 is directed through the inner shell 36 and the sump 70 to aid in boiling of refrigerant in both the inner shell and the sump 70. In the embodiment of FIG. 5, the hot gas flow 42 is directed through both the inner shell 36 and the sump 70, but in the embodiment of FIG. 5 the hot gas flow 42 is directed first through the inner shell 36 and then through the sump 70 is series, before being directed back to the evaporator 18. In yet another embodiment, illustrated in FIG. 6, the hot gas flow 42 is not directed from the condenser 14, but is directed from a boiler 110. The hot gas flow 42 may be directed from the boiler 110 through one or more of the inner shell 36 and the sump 70 to aid in boiling of the refrigerant in the refrigerant and oil mixture 24 in each of the inner shell 36 and the sump 70. The gas flow 42 may then be routed back to the boiler 110 for reboiling.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vaporizer of a chiller system, comprising:

an inner shell through which a refrigerant and oil mixture is flowed;

one or more hot gas pathways extending through the inner shell from a hot gas inlet to a hot gas outlet, through which a hot gas is flowed to boil refrigerant in the refrigerant and oil mixture;

an outer shell in which the inner shell is embedded, the outer shell defining a sump fluidly connected to the inner shell via a sump inlet line to deliver the refrigerant and oil mixture from the inner shell to the sump;

a sump heater disposed in the sump, configured to boil additional refrigerant from the refrigerant and oil mixture;

a vaporizer vent port to remove boiled vapor refrigerant from the inner shell; and a sump vapor refrigerant outlet separated from the vaporizer vent port to remove boiled refrigerant from the sump;

wherein the boiled refrigerant from the inner shell and the boiled refrigerant from the sump are combined along a compressor return line upstream of a compressor inlet.

2. The vaporizer of claim 1, further comprising a vaporizer immersed heater disposed in the inner shell, the vaporizer immersed heater configured to aid in boiling of refrigerant in the refrigerant and oil mixture.

3. The vaporizer of claim 1, further comprising an oil return line operably connected to the sump to remove oil from the sump.

4. The vaporizer of claim 3, further comprising an oil pump operably connected to the oil return line.

5. The vaporizer of claim 3, further comprising an oil recirculation line operably connected to the oil return line to return oil to the sump.

6. The vaporizer of claim 1, wherein the hot gas outlet is disposed at a first end of the inner shell and the hot gas inlet is disposed at a second end of the inner shell opposite the first end.

7. The vaporizer of claim 1, wherein the inner shell and the sump are disposed inside the outer shell.

8. A chiller system, comprising:

a main refrigerant circuit through which a flow of refrigerant is circulated, including:

a compressor;

a condenser; and an evaporator;

a vaporizer fluidly connected to the main refrigerant circuit to remove refrigerant from a refrigerant and oil mixture, the vaporizer including:

an inner shell through which the refrigerant and oil mixture is flowed;

one or more hot gas pathways extending through the inner shell from a hot gas inlet to a hot gas outlet, through which a hot gas is flowed to boil refrigerant in the refrigerant and oil mixture;

an outer shell in which the inner shell is embedded, the outer shell defining a sump fluidly connected to the inner shell via a sump inlet line to deliver the refrigerant and oil mixture from the inner shell to the sump;

a sump heater disposed in the sump to boil additional refrigerant from the refrigerant and oil mixture;

a vaporizer vent port to remove boiled vapor refrigerant from the inner shell; and a sump vapor refrigerant outlet separated from the vaporizer vent port to remove boiled refrigerant from the sump;

wherein the boiled refrigerant from the inner shell and the boiled refrigerant from the sump are combined along a compressor return line upstream of a compressor inlet.

9. The chiller system of claim 8, further comprising a hot gas line to deliver the hot gas from the condenser to the hot gas inlet of the vaporizer.

10. The chiller system of claim 8, further comprising a gas return line to deliver the hot gas from the hot gas outlet to the evaporator.

11. The chiller system of claim 8, further comprising a vaporizer immersed heater disposed in the inner shell; the vaporizer immersed multi-stage heater configured to aid in boiling of refrigerant in the refrigerant and oil mixture.

12. The chiller system of claim 8, further comprising a compressor return line to deliver the boiled vapor refrigerant from the vaporizer vent port to the compressor.

13. The chiller system of claim 8, further comprising an oil return line operably connected to the sump to remove oil from the sump.

14. The chiller system of claim 13, wherein the oil return line is configured to deliver oil from the sump to the compressor.

15. The chiller system of claim 13, further comprising an oil pump operably connected to the oil return line.

16. The chiller system of claim 13, further comprising an oil recirculation line operably connected to the oil return line to return oil to the sump.

17. The chiller system of claim 8, wherein the hot gas outlet is disposed at a first end of the inner shell and the hot gas outlet inlet is disposed at a second end of the inner shell opposite the first end.

18. The chiller system of claim 8, wherein the inner shell and the sump are disposed inside the outer shell.

* * * * *